US006661380B1

(12) United States Patent
Bancroft et al.

(10) Patent No.: US 6,661,380 B1
(45) Date of Patent: Dec. 9, 2003

(54) MULTI-BAND PLANAR ANTENNA

(75) Inventors: Randy C. Bancroft, Denver, CO (US); Michael D. Zinanti, Wheat Bridge, CO (US); Kenneth T. Lawson, Jr., Lafayette, CO (US); Shanna Carroll French, Morrison, CO (US); Blaine R. Bateman, Louisville, CO (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 10/117,963

(22) Filed: Apr. 5, 2002

(51) Int. Cl.[7] ..... H01Q 1/38

(52) U.S. Cl. ..... 343/700 MS; 343/846; 343/702

(58) Field of Search ..... 343/700 MS, 846, 343/702, 829, 830, 906, 770

(56) References Cited

U.S. PATENT DOCUMENTS

| | | | | | |
|---|---|---|---|---|---|
| 5,734,350 | A | | 3/1998 | Deming et al. | 343/700 MS |
| 5,977,919 | A | * | 11/1999 | Kudo et al. | 343/713 |
| 6,037,525 | A | | 3/2000 | Thompson et al. | 800/298 |
| 6,049,314 | A | | 4/2000 | Munson et al. | 343/846 |
| 6,133,883 | A | | 10/2000 | Munson et al. | 343/700 MS |
| 6,157,344 | A | * | 12/2000 | Bateman et al. | 343/700 MS |
| 6,249,254 | B1 | | 6/2001 | Bateman et al. | 343/700 MS |
| 6,400,322 | B2 | * | 6/2002 | Fang et al. | 343/700 MS |

* cited by examiner

*Primary Examiner*—James Clinger
(74) *Attorney, Agent, or Firm*—Holland & Hart LLP

(57) ABSTRACT

A compact planar antenna is disclosed wherein a radiating element in the shape of a right triangle is formed on a substrate. A ground plane may be positioned on one or both sides of the substrate. A slot extends into the radiating element from one side thereof.

11 Claims, 1 Drawing Sheet

MULTI-BAND PLANAR ANTENNA

Your Petitioners, RANDY C. BANCROFT, a citizen of the Unit States and a resident of the State of Colorado, whose residence and mailing address is 2837 Perry Street, Denver, Colo. 80212; MICHAEL D. ZINANTI, a citizen of the United States and a resident of the State of Colorado, whose residence and mailing address is 4147 Ingalls Court, Wheat Ridge, Colo. 80033; KENNETH T. LAWSON, JR., a citizen of the United States and a resident of the State of Colorado, whose residence and mailing address is 1249 James Circle, Lafayette, Colo. 80026; SHANNA CARROLL FRENCH, a citizen of the United States and a resident of the State of Colorado, whose residence and mailing address is 4432 South Beech Way, Morrison, Colo. 80465; and BLAINE R. BATEMAN, a citizen of the United States and a resident of the State of Colorado, whose post office address is 593 Juniper Court, Louisville, Colo. 80027, pray that Letters Patent may be granted to them for the improvement in

A MULTI-BAND PLANAR ANTENNA

As set forth in the following specification.

BACKGROUND OF THE INVENTION

1. Field of the Invention

This invention relates to a compact, multi-band planar antenna for wireless communication devices such as cellular telephones, PCMCIA cards, etc.

2. Description of the Related Art

For a given physical size and set of antenna performance parameters, such as gain and antenna pattern, multi-band antennas have often been of lower performance than single band antennas of the same size, or conversely have been physically larger than single band antennas of the same performance. Additionally, multi-band antennas have often been more complex in structure than single-band antennas, hence multi-band antennas have been of higher cost than single band antennas. In many cases where multi-band antennas have been applied the multi-band antenna impedance characteristic is not matched to 50 ohms at all the desired bands, hence requiring a matching network to be used in conjunction with the multi-band antenna. In many applications, a multi-band antenna is desired of the same size, cost, and simplicity of a single-band antenna. The need for planar antennas has been well-described in U.S. Pat. Nos. 6,157,344, 6,249,254 and 6,037,525. Thus, there is a need for planar, multi-band antennas which have the advantages of a planar antenna such as in the '344 patent but that operates at two or more frequencies and are no larger than the antenna of the '344 patent. In particular, the telematics market desires a dual-band antenna for the two primary network frequencies (e.g., 860 MHz [AMPS] and 1920 MHz [PCS]).

U.S. Pat. No. 6,307,525 pertains to a multi-band antenna which combines elements of a design of U.S. Pat. Nos. 6,157,344 and 6,249,254 with a multiplexer capable of separating the RF energy based on frequency. While the antenna of the '525 patent performs exceedingly well and has been successfully commercialized, it is relatively large and in general is larger than the area of the antennas which it replaces. Further, the introduction of the multiplexer circuit introduces some losses which reduce the gain of the antenna in the '525 patent, and in some cases, the patterns of the antenna radiation are affected by the presence of the multiplexer. The main advantage of the antenna in the '525 patent is the single port and the planar shape thereof.

SUMMARY OF THE INVENTION

A planar antenna is described which comprises a dielectric substrate fabricated from a commercial PCB laminate or other materials, and a radiating element formed on one side thereof which is formed in the shape of a right triangle or related shape. A slot extends into the radiating element from one side thereof. In some embodiments, a ground plane is provided on one or both sides of the substrate.

It is therefore a principal object of the invention to provide a compact, multi-band planar antenna which is small enough to be used in most applications.

Yet another object of the invention is to provide a compact, multi-band planar antenna which is small enough to be used in most applications without sacrificing gain, pattern and bandwidth performance.

A further object of the invention is to provide a compact, multi-band planar antenna which includes an antenna element in the form of a right triangle or related shape.

Yet another object of the invention is to provide a compact, multi-band planar antenna which is less expensive to manufacture than certain other planar antennas.

These and other objects will be apparent to those skilled in the art.

DETAILED DESCRIPTION OF THE EMBODIMENTS

Figure 1B:
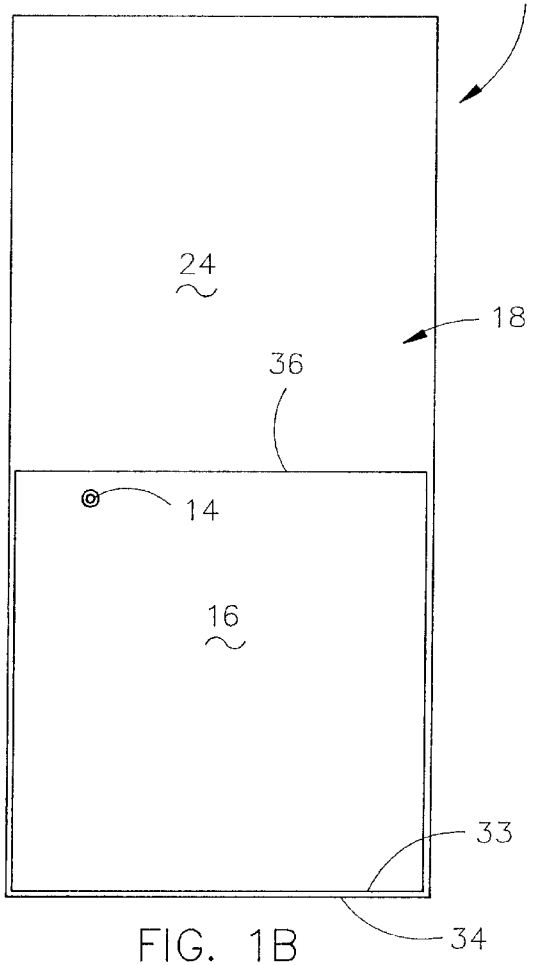
FIG. 1B is a top view of the other side of the substrate of FIG. 1A which illustrates a ground plane provided thereon.
Figure 1A:
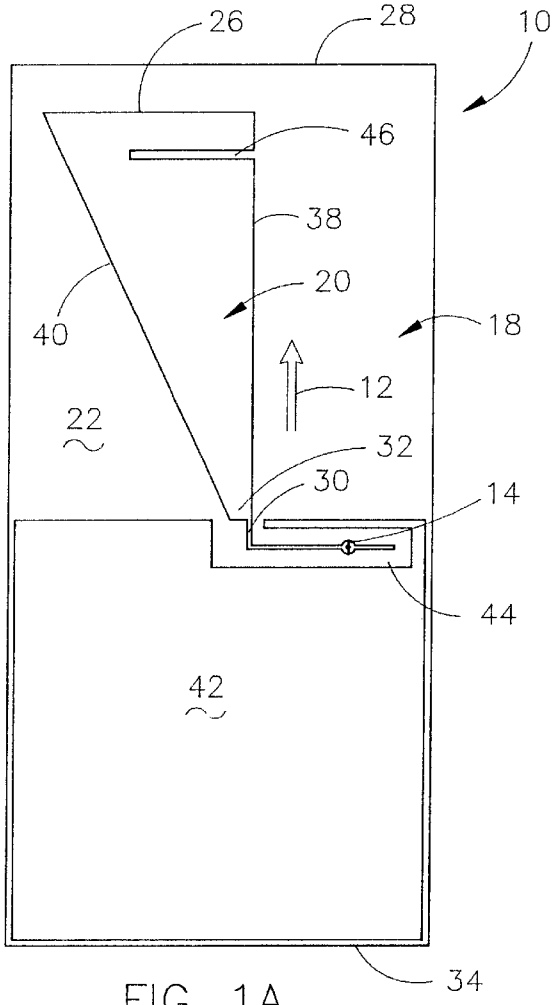
FIG. 1A is a top view of the radiating element side of this invention which also has an optional ground plane element mounted on the same side of the substrate.

FIG. 1A is a top view, i.e., a view from the radiating element side, of an antenna 10 in accordance with this invention wherein a final protective non-conductive plastic coating has not been applied to the antenna, and wherein the centrally located long-axis of antenna 10 is shown by arrow 12. FIG. 1B is a bottom view, i.e., a view from the ground plane element side, of an antenna 10. The numeral 14 refers to a through hole which extends through the ground plane 16, substrate 18, and the antenna element 20 to facilitate the connection of a feed cable to the antenna.

Without limitation thereto, in a preferred embodiment of the invention, substrate 18 of antenna 10 is formed from a relatively thin commercial PCB laminate substrate such as glass epoxy. The top and bottom flat surfaces 22 and 24 of substrate 18 carry a thin layer, coating, or film of a metal such as copper. Copper-clad substrate 18 is processed, for example, by using well-known masking and etching techniques, to provide (1) a first metal pattern on the FIG. 1A side of the substrate 18, this first metal pattern comprising a right-triangle-shaped metal radiating element 20 whose base 26 is positioned coincident with, or closely adjacent to, a first side edge or edge surface 28 of said substrate 18, and to provide a metal feed line 30 which extends from the apex 32 of the triangle, and to provide (2) a second metal pattern on the FIG. 2 side of the substrate 18, the second pattern comprising a metal ground plate element 16 having a first edge 32 that is positioned coincident with, or closely adjacent to, the second side edge or edge surface 33, and having a second edge 36 that dimensionally overlaps a portion of feed line 30, but does not overlap radiating element 20.

In the preferred embodiment of the invention, but without limitation thereto, substrate 18 is a rectangle, radiating element 20 is formed as a right triangle having sides 38 and 40 extending from the base 26 to the apex 32.

The manner of electrically connecting the antenna's radiating element 20 and ground plane element 16 may take a number of forms within the spirit and scope of this invention. For example, one edge connector could be connected to feed line 30, and a second edge connector could be connected to ground plane element 16. In the embodiment shown in the drawings, the through hole 14 permits a co-axial cable to be operatively connected to the ground plane element 16 and the antenna element 20.

In an embodiment of the invention, a second ground plane element 42 may be formed on the radiating element side of the antenna 10 as seen in FIG. 1 with the ground plane element 42 having a cut-out portion 44 which receives the feed line 30 as illustrated in FIG. 1A.

Radiating element 20 has a slot 46 formed therein which provides for a multiplicity of current paths which give rise to the multi-banding characteristics of this invention. As seen in FIG. 1A, one end of slot 46 is open while the other end thereof is closed. Slot 46 produces multiple current paths leading to the multiple radiating resonances from the structure without additional antenna size. The dimensions and geometry of the slot 46 may be altered to achieve a desired frequency for the second primary resonant band. If needed, a simple microstrip transmission line matching network may be added to the antenna feed point 30 to increase the bandwidth and impedance match of the desired resonances. The antenna of this invention has two or more useful bands, radiating in a monopole or dipole mode, with the size requirements being about fifty percent of the currently commercialized antenna of the '344 patent without any additional components.

In some applications, a PCB is required for the addition of components, such as the LNA stage of a GPS receiving antenna. The antenna of this invention provides the required PCB area as part of the existing ground plane of the antenna, allowing a more cost-effective and smaller solution than a separate PCB for the GPS antenna assembly, which has been the solution used by others in the past, and allows a more cost-effective and smaller solution than the existing prior art antennas.

In other applications, a second GPS antenna assembly is desired to be integrated with the antenna. In such an application, the GPS antenna assembly requires a ground plane. The invention herein provides the necessary ground plane as part of the antenna, allowing a more cost-effective and smaller solution than a separate ground plane, which has been the solution used by others in the past, and which allows a more cost-effective and smaller solution than the existing prior art antennas.

The antenna of this invention allows a single antenna to be used for multiple bands without additional cabling or connections to the transmitter/receiver. In cases where multiple carriers desire to connect to one system, such as a multi-carrier in-building voice system, the use of one multi-band antenna replicated in times may permit economies of scale for the single part number rather than two or three or in separate parts for the various frequencies. Using the approach of this invention for telematic applications allows a smaller antenna to be used than the integrated diplexer approach. The advantage of this invention is critical for on-glass and stealth antennas which must be as small as possible.

The planar antenna of this invention is ideally suited in wireless applications here small antennas are required for minimal visual impact (stealth) and in telematics applications where small planar antennas are useful to allow the device to be hidden within a vehicle. In addition, the antenna is useful in portable wireless devices including PCMCIA cards wherein the size of the card is predetermined thereby limiting the space which is available for antennas. Due to the small size of the antenna of this invention, it is useful in linear array antennas since it minimizes the resulting size of the array.

The antenna of this invention is approximately one-half the size of the Microsphere™ antenna described in U.S. Pat. No. 6,157,344 with identical gain, pattern and bandwidth performance. The antenna of this invention is ideal, suited for all the uses (applications) set forth in the '344 patent.

Thus it can be seen that the invention accomplishes at least all of its stated objectives.

We claim:

1. A multi-band planar antenna, comprising:

a flat dielectric substrate having a first surface, a second surface that is generally parallel to said first surface, a first edge, and a second edge which is located generally opposite said first edge;

a metal radiating element on said first surface of said substrate;

said radiating element having a generally right triangle shape including a linear base located generally adjacent to said first edge of said substrate, a first linear side extending from one end of said base, and a second linear side extending from the other end of said linear base, said radiating element having a triangle apex which is formed by the intersection of said first and second linear sides;

a linear metal feed line including and formed as an extension of said triangle apex, said feed line extending in a direction away from said triangle base and extending from said triangle apex toward said second edge of said substrate;

a metal ground plane element on said second surface of said substrate, said ground plane element having a first edge located generally adjacent to said second edge of said substrate;

said ground plane element having a second edge that dimensionally overlaps said feed line and only said apex of said radiating element;

said ground plane element being electrically connected to said radiating element;

said radiating element having a slot formed therein which extends inwardly into said first side of said radiating element.

2. The antenna of claim 1 wherein said slot is generally parallel to said base of said radiating element.

3. The antenna of claim 2 wherein said slot is formed in said radiating element adjacent said first edge of said substrate.

4. The antenna of claim 1 wherein a second metal ground plane element is provided on said first surface of said substrate.

5. A multi-band planar antenna, comprising:

a flat dielectric substrate having a first surface, a second surface that is generally parallel to said first surface, a first edge, and a second edge which is located generally opposite said first edge;

a metal radiating element on said first surface of said substrate;

said radiating element having a generally right triangle shape including a linear base located generally adjacent to said first edge of said substrate, a first linear side extending from one end of said base, and a second linear side extending from the other end of said linear base, said radiating element having a triangle apex which is formed by the intersection of said first and second linear sides;

said radiating element having a:slot formed therein which extends inwardly into said first side of said radiating element.

6. The antenna of claim 5 wherein a metal ground plane element is provided on said second surface.

7. The antenna of claim 5 wherein a metal ground plane element is provided on said first surface.

8. The antenna of claim 7 wherein a metal ground plane element is also provided on said second surface.

9. The antenna of claim 6 wherein a linear metal feed line extends from said apex of said radiating element.

10. The antenna of claim 9 wherein said feed line extends to a feed point.

11. The antenna of claim 10 wherein said feed line has a predetermined length and width so as to form part of a matching network.

* * * * *